United States Patent [19]

Meyer et al.

[11] 4,136,026

[45] Jan. 23, 1979

[54] CAUSTIC SOLUTION HAVING CONTROLLED DISSOLVED ALUMINUM CONTENT

[75] Inventors: Raymond J. Meyer, Apollo; Wayne F. Johnson, Lower Burrell; Richard A. Wodehouse, New Kensington, all of Pa.

[73] Assignee: Aluminum Company of America, Pittsburgh, Pa.

[21] Appl. No.: 854,271

[22] Filed: Nov. 23, 1977

[51] Int. Cl.[2] ..... C02B 1/20

[52] U.S. Cl. ..... 210/45; 210/46; 210/47; 210/59; 156/642

[58] Field of Search ..... 210/45, 46, 47, 59; 156/642

[56] References Cited

U.S. PATENT DOCUMENTS

| | | | |
|---|---|---|---|
| 2,828,193 | 3/1958 | Newman | 156/642 |
| 2,975,041 | 3/1961 | Holman | 156/642 |
| 3,486,954 | 12/1969 | Ashcraft | 156/642 |
| 3,607,482 | 9/1971 | Selm | 156/642 |
| 3,712,838 | 1/1973 | Weissenberg | 156/642 |
| 3,909,405 | 9/1975 | Aoyama | 210/46 |

FOREIGN PATENT DOCUMENTS

| | | | |
|---|---|---|---|
| 5120971 | 12/1972 | Japan | 156/642 |
| 50-837 | 3/1976 | Japan | 210/46 |

*Primary Examiner*—John Adee

*Attorney, Agent, or Firm*—Andrew Alexander

[57] ABSTRACT

A method of controlling the dissolved aluminum content of a caustic solution for etching aluminum comprises providing a tank of an etching solution containing sodium hydroxide and water and etching aluminum in the solution to dissolve aluminum therein. A portion of this etch solution is introduced to a reactor for purposes of lowering its aluminum content by treating with aluminum hydroxide. The treatment is capable of causing dissolved aluminum to precipitate from the etch solution in a mean residence time of less than 5 hours. A portion of the solution in the reactor is filtered to remove aluminum hydroxide solids to an extent sufficient to prevent precipitation in the etching tank. The filtered solution is then returned to the etching tank thereby controlling the aluminum content of the etching solution.

16 Claims, 2 Drawing Figures

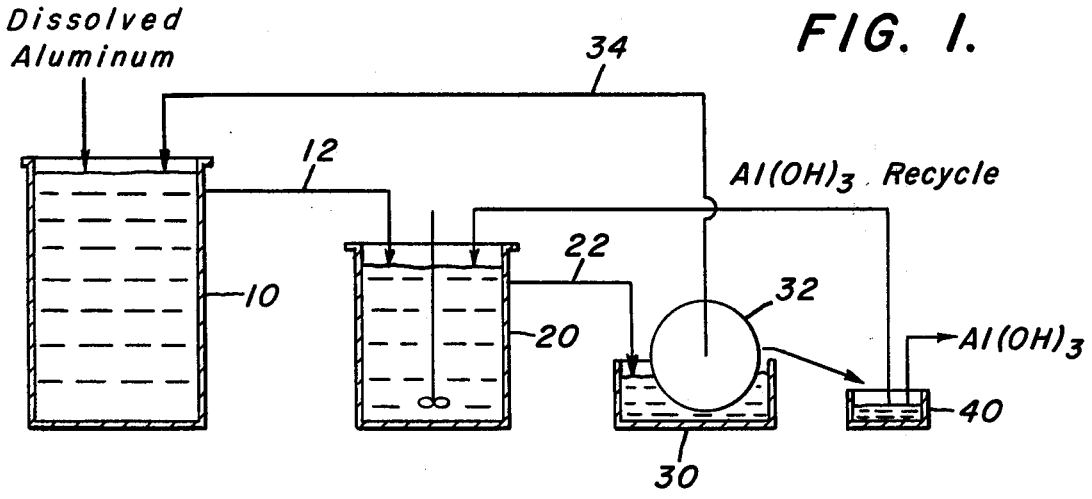
FIG. 1.
FIG. 2.
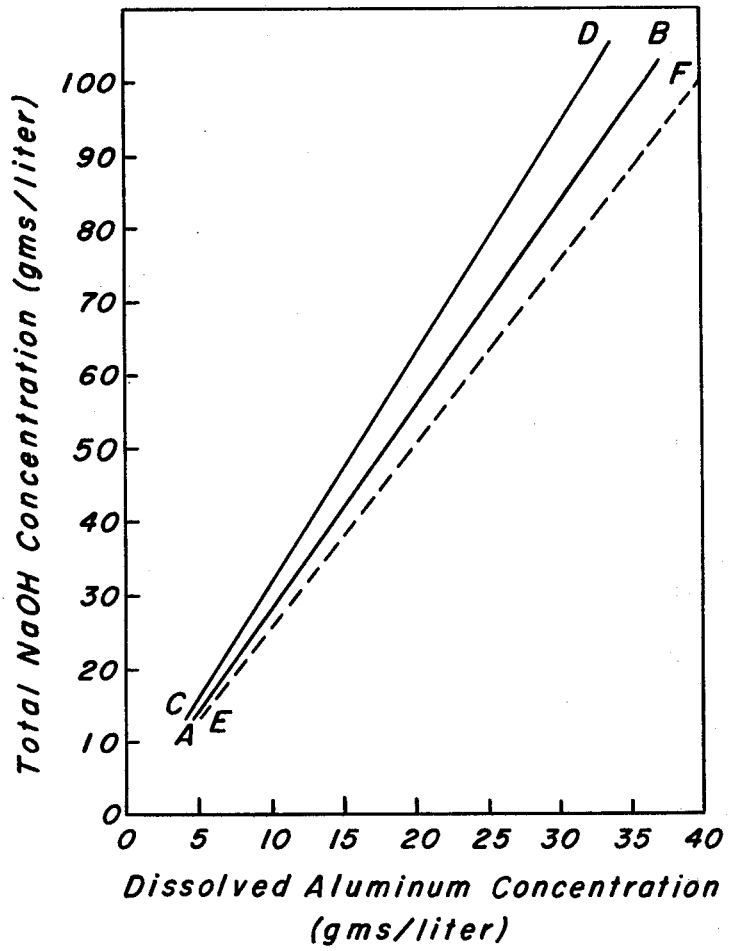

CAUSTIC SOLUTION HAVING CONTROLLED DISSOLVED ALUMINUM CONTENT

BACKGROUND OF THE INVENTION

This invention relates to a caustic solution for etching aluminum and more particularly, it relates to a method of controlling the dissolved aluminum content of the solution.

Caustic etching is employed in the aluminum finishing industry for both functional and decorative purposes. For example, all aluminum used for anodizing purposes is etched initially in order to provide a uniform surface appearance. During the etching process, aluminum dissolves and combines with the sodium hydroxide to form sodium aluminate according to the reaction $$2Al + 2NaOH + 2H_2O \rightarrow 2NaAlO_2 + 3H_2 \uparrow$$

Through use, the effective NaOH content of the solution decreases and the concentration of $NaAlO_2$ increases. Eventually, the solution becomes saturated with $NaAlO_2$, at which point aluminum hydroxide will precipitate in accordance with the reaction $$2NaAlO_2 + 4H_2O \rightarrow 2Al(OH)_3 \downarrow + 2NaOH$$

It can be seen from both chemical equations that the overall reaction is between aluminum and water yielding hydrogen and aluminum hydroxide. Thus, the caustic solution should only consume NaOH in an amount equivalent to that which is dragged out by the work loads since precipitation of $Al(OH)_3$ liberates or frees sodium hydroxide again. However, there are problems which arise when an etch solution is used in this way. For example, when $Al(OH)_3$ precipitates, it forms a hard rock-like scale on the tank and on heat exchanger walls which scale is very difficult to remove. Also, for purposes of keeping the etch rate constant, fresh NaOH has to be added to make up for that consumed as $NaAlO_2$. To avoid such problems in conventional practice, the etch solution must be discarded before precipitation occurs. Thus, the etch tank must be drained and cleaned frequently, causing costly production downtime as well as using NaOH very inefficiently.

To decrease the number of times the etch solution must be drained, a chelating agent such as sodium gluconate may be added to retard spontaneous precipitation of $Al(OH)_3$. However, as noted above, to maintain consistent operation, NaOH must be added periodically. Thus, the etch continually increases in total NaOH and dissolved aluminum. Eventually, the etch solution becomes very concentrated, resulting in a viscous solution which does not etch uniformly. At this point, the solution normally has to be discarded, again resulting in wasted NaOH and in production downtime.

In an approach to minimize these problems, often caustic solutions are maintained at an equilibrium composition by continually discharging etch solution and replenishing such with fresh NaOH, water, and other additives. While this method obviates the production downtime problem, it consumes sodium hydroxide in relation to aluminum processed instead of the minimal loss due to removing the work load. All of this inefficiently utilized NaOH plus the aluminum thereby dissolved during etching is ultimately lost to waste treatment and disposal.

The present invention eliminates the problems attendant the operation of a caustic solution for etching aluminum by providing a method which controls the dissolved aluminum content of the caustic solution. The method of the present invention substantially eliminates any need to dump the solution for reason of its becoming inoperative. Also, the method, as well as eliminating downtime for preparing new solutions, can result in as much as a 90% reduction in the consumption of sodium hydroxide, when compared to conventional practices. In addition, in the present invention, NaOH can be liberated or regenerated at a rate substantially equal to its consumption during etching thereby ensuring a relatively constant level of NaOH in the etching solution.

SUMMARY OF THE INVENTION

An object of the present invention is to extend the useful life of a caustic solution for etching aluminum.

Another object of the present invention is to minimize the amount of sodium hydroxide to be added to a caustic solution for etching aluminum.

Yet another object of the present invention is to substantially eliminate dumping of caustic solutions for etching aluminum.

And yet another object of the present invention is to extend the useful life of a caustic solution for etching aluminum by controlling the dissolved aluminum content thereof.

These and other objects will become apparent from an inspection of the drawings, specification and claims.

In accordance with these objects, a method of extending or preserving the useful life of a caustic solution for etching aluminum by controlling the dissolved aluminum content of the solution comprises providing an etching solution containing sodium hydroxide and water, etching aluminum in the solution thereby dissolving aluminum therein, introducing a portion of the etch solution containing the dissolved aluminum to a reactor and treating the etch solution with aluminum hydroxide to lower the aluminum content by causing dissolved aluminum to precipitate as aluminum hydroxide. Simultaneously with the precipitation treatment, a portion of the etch solution containing precipitated aluminum hydroxide is preferably filtered to remove aluminum hydroxide to an extent which prevents precipitation in the etching tank. The filtered solution is recirculated to the etch tank.

BRIEF DESCRIPTION OF THE FIGURES

FIG. 1 is a schematic representation illustrating steps in accordance with the principles of the present invention.

FIG. 2 is a graph depicting ranges of caustic solution concentrations and related dissolved aluminum ranges in accordance with principles of the present invention.

DETAILED DESCRIPTION OF THE PREFERRED EMBODIMENTS

Referring now to FIG. 1, there is shown a method of preserving or extending the useful life of a caustic solution for etching aluminum. The useful life is extended by controlling the dissolved aluminum content of the caustic solution in accordance with the principles of the present invention. In the method, a caustic solution containing sodium hydroxide and water is provided in tank 10 and aluminum articles are etched therein thereby dissolving aluminum in the solution. For purposes of the present invention, the caustic solution can have a total NaOH concentration as low as 15 grams per liter and satisfactory etching of aluminum articles can be obtained. However, it is preferred that the total NaOH concentration of the caustic solution be maintained in the range of 35 to 50 grams per liter since a concentration in this range will provide a more efficient etching rate at lower temperatures. The lower temperatures provide a savings at least in the cost of heating the solution. The solution can be used for etching purposes at a temperature in the range of 80° to 180° F. with a preferred range being 110° to 145° F. It should be noted that higher concentrations of caustic solution can be used. For example, solutions having concentrations in the neighborhood of 100 grams per liter as in conventional practices may be used. However, as will be explained hereinbelow, higher concentrations result in greater losses in the amount of NaOH being removed from the tank upon removal of the aluminum workpiece. Thus, for purposes of the present invention, high concentrations of caustic solution are best avoided since essentially only NaOH removed by the workpiece has to be replaced in the present invention. That is, in the present invention, after a satisfactory caustic solution has been provided there is no need to dump such solution and make up fresh solutions. Also, there is no need to add NaOH to the solution for purposes of replenishing NaOH used up by virtue of the etching process. As noted, essentially only NaOH removed by the workpiece has to be replaced. Thus, it will be apparent that such removal should be minimized.

It will be understood that etching of the aluminum article increases the amount of aluminum dissolved in the caustic solution. In the present invention, it is preferred to permit the aluminum content of the caustic solution to approach the saturation point of the solution. That is, for purposes of removal of the dissolved aluminum to be described later, it has been discovered that the caustic solution should be operated with a high concentration of dissolved aluminum. However, it should be operated at a dissolved aluminum concentration short of that which permits it to spontaneously precipitate out as $Al(OH)_3$ in the etch tank. The relationship of dissolved aluminum content to the total NaOH content in the caustic solution is shown in FIG. 2. The dissolved aluminum concentration should be in a range as related to the total NaOH concentration as defined by the area between lines A–B and C–D of FIG. 2. Typically, the etch solution is operated at dissolved aluminum concentrations represented by the line A–B. It should be noted that dissolved aluminum concentrations as related to the NaOH concentrations lower than depicted by the line C–D may be used but on a much less preferred basis. Also, aluminum concentrations greater than those depicted by the line A–B may be used but at the risk of initiating spontaneous precipitation in the etch tank. The line E–F denotes the point at which dissolved aluminum will start to precipitate out spontaneously in the etch tank.

Referring once again to FIG. 1, it will be noted that a portion of the caustic solution containing dissolved aluminum is transferred more or less on a continuous basis from tank 10 along line 12 to reactor 20. Aluminum hydroxide in particle form is maintained suspended in the solution in reactor 20 at a controlled level for purposes of precipitating the dissolved aluminum. Simultaneous with the introduction of solution from tank 10, caustic solution is removed from reactor 20 along line 22 at a rate substantially commensurate with the introduction rate. The stream being removed from reactor 20 has a lower dissolved aluminum content than the stream entering the reactor by virtue of precipitating aluminum as aluminum hydroxide. For example, in a caustic solution containing 35 grams per liter NaOH and 12 grams per liter dissolved aluminum, the exit stream from the reactor, after precipitation, has a dissolved aluminum content of about 7.5 grams per liter. It will be remembered that the exit stream from the reactor also contains aluminum precipitated as $Al(OH)_3$ which, of course, unlike the dissolved aluminum, is not recirculated to caustic etch tank 10.

Exit stream 22 is circulated to container 30 for purposes of substantially separating the precipitated $Al(OH)_3$ from the caustic solution. The $Al(OH)_3$ precipitate can be separated from the solution by contrifuging; however, preferably the separation is carried out by a continuous vacuum drum type filter 32 well known to those skilled in the art. $Al(OH)_3$ precipitate is collected on the outside of the drum filter, scraped off and collected in container 40. The caustic solution from which the $Al(OH)_3$ precipitate has been substantially removed is recirculated along line 34 to etch tank 10 at a rate substantially commensurate with its removal therefrom. With respect to $Al(OH)_3$ collected in container 40, preferably a portion thereof is recirculated to the reactor for purposes of maintaining controlled amounts of $Al(OH)_3$ for precipitating dissolved aluminum. That is, after initial start-up of the process, preferably $Al(OH)_3$ is removed from the system commensurate in amount with aluminum dissolved from the workpiece in etching tank 10.

An important aspect of the present invention resides in the period required to precipitate the dissolved aluminum in reactor 20. In the present invention, precipitation can be initiated in a very short period. For example, precipitation can occur during a mean residence time of one hour. By mean residence time is meant the average time an element of fluid is held in the reactor as determined by dividing the reactor volume by the volumetric flow rate into the reactor. However, preferably, the precipitation of the dissolved aluminum is made to occur in a mean residence time of less than 5 hours with a typical time being in the range of 2 to 4.5 hours. It should be noted that residence times for precipitation to occur can reach 30 to 35 hours. However, such long residence times to remove dissolved aluminum are considered to be uneconomical. In order to effect precipitation of aluminum dissolved in the caustic solution in accordance with the residence times indicated, it is important that the concentration of dissolved aluminum is in the range of 0.32 to 0.40 times the total NaOH concentration. Preferably, the concentration of the caustic solution for these ranges of dissolved aluminum is in the range of 15 to 50 grams per liter NaOH. Higher caustic concentrations are permissible but can result in inefficient operation of the process.

Another factor which is important in obtaining a high precipitation rate of dissolved aluminum is the concentration of $Al(OH)_3$ maintained in the reactor. Thus, for purposes of seeding or promoting a high precipitation reaction rate, the $Al(OH)_3$ concentration can range from 30 to 600 grams per liter of solution in the reactor. However, for purposes of obtaining maximum benefit from the dissolved aluminum concentration mentioned above, best results are obtained if the $Al(OH)_3$ concentration in the reactor is maintained in the range of 200 to 500 grams per liter. Typical operating ranges for $Al(OH)_3$ in the reactor is in the range of 300 to 400 grams per liter. Lower concentrations of $Al(OH)_3$ normally result in uneconomically slow reaction rates. In addition to $Al(OH)_3$ concentrations, for purposes of the invention, it is important to maintain the solution in the reactor at a temperature of at least 120° F. and preferably in the temperature range of 125° to 160° F. with typical operating temperatures being in the range of 130° and 150° F. Maintaining the temperature at this level in combination with the above controls aids in obtaining a high rate of precipitation of the dissolved aluminum.

While the inventor does not necessarily wish to be bound by any theory of invention, it is believed that shorter residence times for precipitation of dissolved aluminum result from a greater degree of solution instability and from more aluminum being present or available to react in a unit time with the higher concentrations of $Al(OH)_3$ present in the reactor. By comparison, it is believed that low concentrations of dissolved aluminum require a much greater period to undergo equivalent precipitation, retarding the overall process.

It should be noted that the period for precipitation of dissolved aluminum is very important in a continuous process. That is, if periods of around, for example, 8 hours or greater are required for precipitation, then several reactors or an extremely large reactor would be required which would seriously interfere with the economics of the process. Also, it will be noted that it is imperative in a continuous process to have the capability of removing aluminum about as quickly as it is dissolved in order to avoid accumulation of dissolved aluminum and its precipitation as $Al(OH)_3$ in the etch tank and its attendant problems.

An important aspect of the present invention resides in maintaining the caustic solution so that it will etch aluminum articles at a controlled rate. That is, it is important to maintain the caustic solution such that a large variation in etching rate does not occur and that the maximum etching rate is obtained for efficiency purposes. Thus, in the present invention, the etching solution can be operated to dissolve as much as 1 gram per liter-hour without fear of initiating spontaneous precipitation in the etching tank. That is, the rate of dissolution of aluminum into the etching solution can be as much as 1 gram per liter-hour and yet the dissolved aluminum can be removed at a rate substantially commensurate with its introduction.

In the process of the present invention, it has been discovered that under the controlled conditions outlined above the precipitation rate in the reactor normally predominates over the rate at which aluminum can be dissolved into the caustic solution by etching. This permits the reactor to be sized much smaller than the caustic etch tank. Thus, in a preferred embodiment of the invention, the reactor can have a size of 25 to 50% the size of the etch tank.

In operation of the process of the present invention, it will be found that very fine insoluble particles, referred to in the art as smut, tend to accumulate in the etch tank. Thus, it is preferred that the caustic solution be filtered so as to remove such fine particles. This auxiliary filter may be placed in the line between the etch tank and reactor or the caustic solution can be filtered independent of the reactor.

While the reactor has been shown in FIG. 1 as being independent from the filtration process, it should be understood that the drum filter may be a part of the reactor. That is, the filter may simply be immersed in the solution of the reactor.

The following examples are still further illustrative of the invention.

EXAMPLE 1

A caustic solution containing 49.8 grams per liter total NaOH and 18 grams per liter dissolved aluminum was provided in an etch tank. The solution was operated at a temperature of 120° F. and aluminum was dissolved therein at a rate of 1 gram per liter per hour. A reactor having a volume of 36% of the etch tank volume was provided with "slurry" kept at a temperature of 140° F. The reactor slurry consisted of 25.5 wt.% $Al(OH)_3$, the remainder comprising the aforesaid etch solution. The flow rate to the reactor from the etch tank was 2.08 liters per minute per 1000 liters of etch tank volume. A rotary drum filter having a filter area of 0.0872 square meters per unit process flow rate (liters per minute) was used at a vacuum level of 25.4 cm Hg and at a drum rotation speed of 0.75 revolutions per minute providing 0.0654 $m^2$ of filter area each minute for separation of precipitated $Al(OH)_3$ and caustic solution from the reactor slurry. Clear filtrate, i.e. caustic solution deficient in dissolved aluminum with respect to the etch tank, was recirculated back to the etch tank and about 94% of the $Al(OH)_3$ filter cake was recirculated back to the reactor. The system operated as described provided a mean residence time of about 2.9 hours. The system was operated continuously for 17 hours to ensure that steady state conditions were obtained. The equilibrium dissolved aluminum concentration of the solution in the reactor was 11.8 grams per liter. A water wash was provided for the filter cake, resulting in a 1.8 grams per liter dilution and the flow returning to the etch tank contained 10 gms of dissolved aluminum per liter of solution. The equilibrium dissolved aluminum concentration of the solution in the etch tank was 18 grams per liter. Thus, aluminum concentration in the caustic solution was maintained constant through continual removal of aluminum at a rate of 1 gram per liter-hours which is equal to the aluminum input rate.

EXAMPLE 2

The conditions were the same as in Example 1 except the caustic solution contained 35 grams per liter total NaOH and 12.3 grams per liter of dissolved aluminum and was operated at 125.6° F. The reactor had a volume of about 44% of the volume of the etch tank and was operated at 143.6° F. The flow rate to the reactor was 3.12 liters per minute per 1000 liters of etch tank volume, providing a mean residence time of 2.35 hours. Analysis of the flow returning to the etch tank from the reactor showed the solution to contain 7 grams dissolved aluminum per liter. Thus, 5.3 grams of dissolved aluminum per liter of solution cycled through the reactor each hour was precipitated. Thus, aluminum was removed at a rate equivalent to that at which it was introduced or dissolved in the etch tank. The system was operated under these conditions for 10 hours without any appreciable accumulation of dissolved aluminum in the etch tank.

EXAMPLE 3

The conditions were the same as in Example 1 except the caustic solution contained 20 grams NaOH per liter and 8 grams dissolved aluminum per liter of solution. The temperature of the caustic solution in the etch tank was 132° F. and 152.6° F. in the reactor. The reactor volume was 50% of the etch tank. The flow rate to the reactor from the etch tank was 4.16 liters per minute per 1000 liters of etch tank volume, providing a mean residence time of 2 hours. Analysis of the solution being removed from the reactor showed the dissolved aluminum to be present at 4.0 grams per liter of solution. Thus, 4.0 grams dissolved aluminum per liter of solution cycled through the reactor each hours were precipitated. Thus, dissolved aluminum was removed substantially at the same rate as it was introduced to the etch tank. The system was operated for a period of 7 hours and no appreciable accumulation of dissolved aluminum was observed in the etch tank.

While the invention has been described in terms of preferred embodiments, the claims appended hereto are intended to encompass other embodiments which fall within the spirit of the invention.

What is claimed is:

1. A method of greatly extending the useful life of a caustic solution for etching aluminum by controlling the dissolved aluminum content of the caustic solution comprising the steps of:

(a) providing a tank of etching solution containing sodium hydroxide, the balance comprising water;

(b) etching aluminum in the etch solution thereby dissolving aluminum therein;

(c) introducing a portion of the etch solution containing the dissolved aluminum to a reactor for purposes of lowering the aluminum content thereof;

(d) treating the etch solution in the reactor with aluminum hydroxide to lower the dissolved aluminum content thereof by causing said dissolved aluminum to precipitate as aluminum hydroxide, aluminum hydroxide being maintained in the reactor in the range of 30 to 600 gms/liter of solution, the treatment capable of causing the dissolved aluminum to precipitate from the etch solution at a rate substantially commensurate with the rate of introducing aluminum during etching and capable of being effective when the solution has a mean residence time of less than 5 hours in the reactor;

(e) removing a portion of the etch solution and aluminum hydroxide from the reactor on a substantially continuous basis, the aluminum hydroxide being separated from the etch solution to an extent which prevents precipitation of dissolved aluminum in the etching tank, the solution being removed from the reactor at a rate substantially commensurate with the rate at which it is introduced in step (c); and (f) recirculating the portion of solution to the etch tank thereby controlling the dissolved aluminum content of the etching solution.

2. The method according to claim 1 wherein the caustic etch solution has a dissolved aluminum content as related to the total NaOH concentration as defined by the area between the lines A–B and C–D of FIG. 2.

3. The method according to claim 1 wherein the temperature of the etching solution in step (a) is in the range of 80° to 180° F.

4. The method according to claim 1 wherein the temperature of the etching solution in step (a) is in the range of 110° to 145° F.

5. The method according to claim 1 wherein the etching solution has a dissolved aluminum content in the range of 0.32 to 0.40 times the total NaOH concentration of the caustic etch solution in step (a).

6. The method according to claim 1 wherein the etching solution in step (a) has a NaOH concentration in the range of 15 to 50 grams per liter.

7. The method according to claim 1 wherein $Al(OH)_3$ is maintained in the reactor in the range of 200 to 500 grams per liter.

8. The method according to claim 1 wherein the solution in the reactor is greater than 120° F.

9. The method according to claim 1 wherein the solution in the reactor is controlled at a temperature in the range of 125° to 160° F.

10. The method according to claim 1 wherein in step (e) the $Al(OH)_3$ is filtered for purposes of separating it from the etching solution.

11. The method according to claim 1 wherein in step (b) aluminum is dissolved by etching at a rate not greater than 1 gram per liter-hour.

12. A method of greatly extending the useful life of a caustic solution for etching aluminum by controlling the dissolved aluminum content of the caustic solution, the method comprising the steps of:

(a) providing a tank of etching solution containing sodium hydroxide, the balance comprising water, the solution maintained at a temperature in the range of 110° to 145° F.;

(b) etching aluminum in the solution at a rate not greater than 1.0 grams per liter of solution per hour and maintaining a dissolved aluminum content in the range of 0.32 to 0.40 times the total NaOH concentration in the caustic etch solution;

(c) introducing a portion of the etch solution containing the dissolved aluminum to a reactor for purposes of lowering the aluminum content thereof;

(d) treating the etch solution in the reactor with aluminum hydroxide to lower the dissolved aluminum content thereof by causing said dissolved aluminum to precipitate as aluminum hydroxide, the solution being maintained at a temperature in the range of 125° to 160° F. and aluminum hydroxide being maintained in the reactor at a concentration in the range of 200 to 500 grams per liter of solution, the treatment capable of causing the dissolved aluminum to precipitate from the etch solution at a rate substantially commensurate with the rate of introducing aluminum during etching;

(e) removing a portion of the etch solution and aluminum hydroxide from the reactor on a substantially continuous basis, aluminum hydroxide being separated from the etch solution by filtering to an extent which prevents precipitation of dissolved aluminum in the etching tank, the solution being removed from the reactor at a rate substantially commensurate with the rate at which it is introduced in step (c); and (f) recirculating the portion of solution to the etch tank thereby controlling the dissolved aluminum content of the etching solution.

13. The method according to claim 12 wherein the solution has a mean residence time in the reactor in the range of 1 to 4.5 hours.

14. The method according to claim 12 wherein aluminum is removed from the process as $Al(OH)_3$ at a rate substantially equal to the rate of introduction of aluminum to the solution by etching.

15. The method according to claim 12 wherein during filtering, $Al(OH)_3$ removed in excess of the equivalent of aluminum introduced by etching is returned to the reactor.

16. The method according to claim 12 wherein the etch solution contains NaOH in the range of 15 to 50 grams per liter.

* * * * *